US006881927B2

(12) United States Patent
Yoshinaga et al.

(10) Patent No.: US 6,881,927 B2
(45) Date of Patent: Apr. 19, 2005

(54) IMAGE FORMING APPARATUS PREVENTING EXCESSIVE INCREASE IN TEMPERATURE OF FIXING DEVICE

(75) Inventors: Hiroshi Yoshinaga, Chiba (JP); Motokazu Yasui, Kanagawa (JP); Hideo Furukawa, Kanagawa (JP); Masanao Ehara, Kanagawa (JP); Hirofumi Ogawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/108,501

(22) Filed: Mar. 29, 2002

(65) Prior Publication Data

US 2003/0000933 A1 Jan. 2, 2003

(30) Foreign Application Priority Data

Mar. 29, 2001 (JP) ..... 2001-096544
Mar. 19, 2002 (JP) ..... 2002-076471

(51) Int. Cl.[7] ..... G03G 15/20
(52) U.S. Cl. ..... 219/216; 399/70; 399/329
(58) Field of Search ..... 219/216, 469; 399/67, 69, 70, 329–331

(56) References Cited

U.S. PATENT DOCUMENTS 4,618,245 A * 10/1986 Fukushi et al. ..... 399/70
5,109,255 A * 4/1992 Nishikawa et al. ..... 399/70
5,465,146 A * 11/1995 Higashi et al. ..... 399/328
5,481,350 A 1/1996 Yasui et al.
5,565,972 A * 10/1996 Honda et al. ..... 399/384
5,714,736 A * 2/1998 Yoneda et al. ..... 219/216
5,729,798 A 3/1998 Yasui et al.
5,742,870 A * 4/1998 Hwang ..... 399/69
5,745,247 A 4/1998 Yasui et al.
5,819,149 A * 10/1998 Watanabe et al. ..... 399/330
5,832,354 A 11/1998 Kouno et al.
5,854,957 A * 12/1998 Morikawa ..... 399/38
5,907,348 A 5/1999 Ogasawara et al.
5,915,147 A 6/1999 Kouno et al.
6,055,390 A * 4/2000 Kurotaka et al. ..... 399/69
6,097,924 A * 8/2000 Okuyama ..... 399/66

(Continued)

FOREIGN PATENT DOCUMENTS

| | | |
|---|---|---|
| JP | 5-6475 | 1/1993 |
| JP | 06-083237 | 3/1994 |
| JP | 06-348172 | 12/1994 |
| JP | 10-133505 | 5/1998 |
| JP | 11-282307 | 10/1999 |
| JP | 2001-228744 | 8/2001 |

OTHER PUBLICATIONS

Patent Abstracts of Japan, JP 2001–005334, Jan. 12, 2001.
Patent Abstracts of Japan, JP 11–084935, Mar. 30, 1999.
Patent Abstracts of Japan, JP 06–202507, Jul. 22, 1994.

*Primary Examiner*—Joseph Pelham
(74) *Attorney, Agent, or Firm*—Oblon, Spivak, McClelland, Maier & Neustadt, P.C.

(57) ABSTRACT

An image forming apparatus including a fixing device that has a rotatable endless belt, a contacting member to contact the rotatable endless belt, a rotatable pressing member contacting the contacting member via the rotatable endless belt to form a nip region, a heating member to heat the rotatable endless belt, a detecting device to detect a temperature of the heating member, a controlling device to control a temperature of the heating member based on a detection result of the detecting device, and a determining device to determine that the sheet-like recording medium has passed through the fixing device. The controlling device controls such that the temperature of the heating member set for the fixing operation is decreased to a temperature set when the sheet-like recording medium has passed through the fixing device, immediately after a last sheet-like recording medium in a series of a job has passed through the fixing device.

27 Claims, 4 Drawing Sheets

U.S. PATENT DOCUMENTS 6,118,955 A * 9/2000 Yoneda et al. ..... 399/69
6,173,136 B1 * 1/2001 Fuchiwaki et al. ..... 399/67
6,198,888 B1 * 3/2001 Kurotaka et al. ..... 399/69
6,219,520 B1 4/2001 Ehara
6,226,488 B1 * 5/2001 Maeyama ..... 399/329
6,501,935 B1 * 12/2002 Hirai et al. ..... 399/329
6,567,639 B1 * 5/2003 Murata et al. ..... 399/329
6,643,478 B1 * 11/2003 Okano ..... 399/70

* cited by examiner

IMAGE FORMING APPARATUS PREVENTING EXCESSIVE INCREASE IN TEMPERATURE OF FIXING DEVICE

BACKGROUND OF THE INVENTION

1. Field of the Invention

The present invention relates to an image forming apparatus, and more particularly to an image forming apparatus incorporating a fixing device that can prevent an excessive increase in a temperature.

2. Discussion of the Background

In an image forming apparatus, such as a copying machine, a facsimile machine, a printer, and other similar devices, an unfixed image that has been transferred onto a recording medium such as a transfer sheet is fixed by a fixing device and the recording medium is discharged as a hard copy. The fixing device includes a pair of rollers provided such that the rollers oppose each other. One roller functions as a heating roller. The other roller functions as a pressure roller to press a recording medium during an image fixing operation. The recording medium having an unfixed image thereon is conveyed to a nip region formed between the heating roller and the pressure roller where the unfixed image is fused and fixed onto the recording medium with heat of the heating roller. A fixing device referred to as a SURF (i.e., surface rapid fusing) type is commonly known. In the SURF type fixing device, a fixing operation is performed through a nip region formed by press-contacting a pressure roller with a heating member having a heating source via a film-shaped endless belt.

In addition, a belt-type fixing device is commonly known. In the belt-type fixing device, a heating member having a heating source and a contacting member contacting an endless belt are provided in a loop of the belt. A fixing operation is performed through a nip region formed by press-contacting a pressure roller with the contacting member via the endless belt.

An example of the belt-type fixing device includes a belt, which is spanned around a plurality of rollers. One of the plurality of rollers (e.g., a fixing roller) is positioned to oppose a pressure roller. Another roller (i.e., a heating roller) of the plurality of rollers, which drives the belt together with the fixing roller includes a heating source inside the roller. The heating source heats the belt while the roller contacts an inner surface of the belt. The pressure roller includes a heating source inside the roller to heat an outer surface of the belt. A volume and a thermal capacity of a belt is smaller than a volume and a thermal capacity of a roller. Thus, a temperature of the belt increases in a shorter period of time compared to that of the roller. An advantage of the belt-type fixing device includes a shorter warm-up time as compared to the fixing device employing the heating roller and pressure roller. In addition, because a heating source is provided inside the pressure roller, the belt is heated from both inner and outer surfaces thereof, resulting in a shorter warm-up time. In the belt-type fixing device, if each of the pair of rollers is formed of aluminum that has high thermal conductivity, the belt is formed of two layers, namely, a releasing layer that includes silicone rubber or fluorine resin layered on a substrate layer including a stainless steel.

The present invention relates to the belt-type fixing device. In the SURF type fixing device, the heating source is provided and controlled in the nip region. Thus, a temperature of the nip region is precisely controlled. Hence, a material having a low thermal capacity is selected as the endless film or heating member to increase a thermal responsivity, thereby having a minimum effect on the temperature of the nip region. However, an elastic member having a large thermal capacity is not provided in the nip region. Thus, if an elastic layer is provided on the pressure roller, a pressing operation, in which an unfixed image is sandwiched between two members having an elastic member, is barely performed. Accordingly, a nip region having a sufficient length is not formed, thereby resulting in a low level of a fixing performance. The nip region having the sufficient length is formed if the pressure roller having the elastic layer is in strong press-contact with an opposing member (i.e., heating member), due to a deformation of the elastic layer. However, the opposing member needs to have high strength. If greater rigidity is provided to the opposing member, a thermal capacity of the opposing member becomes large. In the roller-type fixing device, an elastic layer is provided to the fixing roller. However, a thermal capacity of the heating roller is increased due to the elastic layer, resulting in a long period of warm-up time.

In the belt-type fixing device, an elastic layer is provided to the contacting member because the heating member having a heating source is provided at a position other than the nip region. A temperature of the contacting member need not to be increased to a fixing temperature, but the belt alone is heated to a predetermined temperature. Thus, a long period of time is not required for a warm-up operation. An elastic layer may be provided on the belt having a higher thermal storage capacity. It is preferable that a thickness of the layer is in a range of approximately 50 $\mu$m to approximately 300 $\mu$m because if the thickness is large, a long warm-up time is required. In this case, the belt also functions as an elastic member in the nip region.

In the belt-type fixing device, an excessive heating phenomenon occurs due to a low thermal storage capacity of the belt and a heating position of the belt. A commonly known excessive heating phenomenon in the roller-type fixing device is described below. For example, approximately 90 seconds (i.e., approximately 0.6° C./sec) are generally required in the roller-type fixing device when a temperature of a surface of the roller is increased from 170° C. to 230° C. (i.e., 50° C. difference). The reason why a long period of time is required is due to a large thermal capacity of the roller. In the roller-type fixing device, the excessive heating phenomenon occurs if responsivity of a temperature detecting sensor is slow. This happens because, for example, energization of a heater is not stopped until the surface temperature reaches to approximately 230° C. even if the temperature control is arranged such that the energization is stopped when the surface temperature reaches to 170° C. In this case, if a temperature detection element having a fast responsivity is employed, the above-described problem is solved to a certain extent. The above-described excessive heating phenomenon in the belt-type fixing device occurs even when a temperature detection element having a fast responsivity is employed.

In a recent temperature detecting element, responsivity is improved. Thus, in a fixing device employing a heating member having a low thermal capacity that is heated in a short period of time (for example, in the belt-type fixing device in which a speed of a surface temperature rise is approximately 2.5° C./sec.), a difference between the actual surface temperature and a controlled surface temperature of the belt is made small. The surface temperature of the belt is increased from 170° C. to approximately 230° C. within approximately 20 seconds compared to approximately 90 seconds required in the roller-type fixing device. If the temperature detection element having a fast responsivity is used, a temperature control is arranged such that energization of heater is stopped when the actual surface temperature reaches to approximately 180° C., for example, depending on a temperature from which the surface of the belt is increased.

However, even if the temperature detection element having a fast responsivity is employed in the belt-type fixing device, the below-described excessive heating phenomenon occurs because the belt is locally heated at a position which is different from a position where heat of the belt is greatly absorbed. Namely, the surface temperature of the belt differs by about 10° C. to 20° C. between a portion of the belt that just passed through a heat absorbing region (i.e., nip region) and a portion of the belt that is about at an end of a heating position because of a low thermal storage capacity of the belt. When fixing operation of the last recording medium is completed and a portion of the belt associated with the last fixing operation is moved to a heating position, the portion of the belt is heated by a heating member.

Heat of the heating member is thus absorbed and a temperature of the heating member decreases which is detected by a temperature detection element. Thus, a heater of the heating member is turned on. However, even though the temperature detection element having a fast responsivity is employed, the heating member heats a portion of the belt that is behind the portion of the belt associated with the last fixing operation. Because heat of this portion of the belt is not absorbed by a recording medium, a temperature of this portion is further increased even though the temperature of this portion is higher than the portion of the belt associated with the last fixing operation by about 10° C. to 20° C. Then, the surface temperature of the belt differs by about 15° C. to 30° C. between the highest temperature portion and the lowest temperature portion. Thus, an excessive heating phenomenon occurs. An excessive amount of heat is applied to a recording medium which causes a hot offset phenomenon or produces an adverse effect on glossiness of an image. In addition, an excessive temperature increase inhibiting device, such as a thermal fuse and temperature thermostat is damaged due to an increase of a temperature in a fixing unit. If the belt keeps on rotating under this condition, the surface temperature of the belt is gradually made uniform such that the surface temperature is maintained at a predetermined temperature. However, if the rotation of the belt is stopped for an energy saving purpose, a longer period of time is required before the surface temperature of the belt is made uniform. If the portion of the belt associated with the last fixing operation stops at the nip region, heat of this portion of the belt is absorbed in the nip region (i.e., by a pressure roller). Then, a temperature of this portion of the belt further decreases. Thus, a difference in a temperature between the portion associated with the last fixing operation and the portion of the belt behind the portion associated with the last fixing operation further increases. If the temperature detection element is provided to detect a surface temperature of a heating member including a heating source instead of detecting a surface temperature of the belt at a heating position, a decrease of temperature of the heating member is detected instead of a decrease of temperature of the belt, resulting in a slow response of the temperature detection element, and a delay in controlling a heater.

SUMMARY OF THE INVENTION

The present invention has been made in view of the above-mentioned and other problems and addresses the above-discussed and other problems.

The present invention advantageously provides a novel image forming apparatus wherein an excessive increase of a surface temperature of a heating roller and pressure roller is prevented, thereby obviating the inconvenience of supplying an excessive amount of heat to a following recording medium or damaging an excessive temperature increase inhibiting device, such as a thermal fuse and a thermal thermostat, due to an excessive increase of a temperature inside the apparatus.

According to an example of the present invention, an image forming apparatus comprises a fixing device that includes a rotatable endless belt having a low thermal storage capacity, a contacting member, provided within a loop of the rotatable endless belt to contact the rotatable endless belt, a rotatable pressing member to be in press-contact with the contacting member via the rotatable endless belt to form a nip region-through which a sheet-like recording medium having an unfixed image thereon passes to fix the unfixed image, a heating member provided within the loop of the rotatable endless belt which heats the rotatable endless belt at a heating position located in a region other than the nip region, a detecting device to detect a temperature of the heating member, a controlling device to control the heating member based on a detection result of the detection device such that a temperature of the rotatable endless belt is maintained at a predetermined temperature set for a fixing operation, and a determining device to determine that the sheet-like recording medium has passed through the fixing device. The controlling device controls a temperature of the heating member such that the temperature of the heating member set for the fixing operation is decreased to a temperature set in a case where the sheet-like recording medium has passed through the fixing device, immediately after the determining device determines that a last sheet-like recording medium in a series of a job has passed through the fixing device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
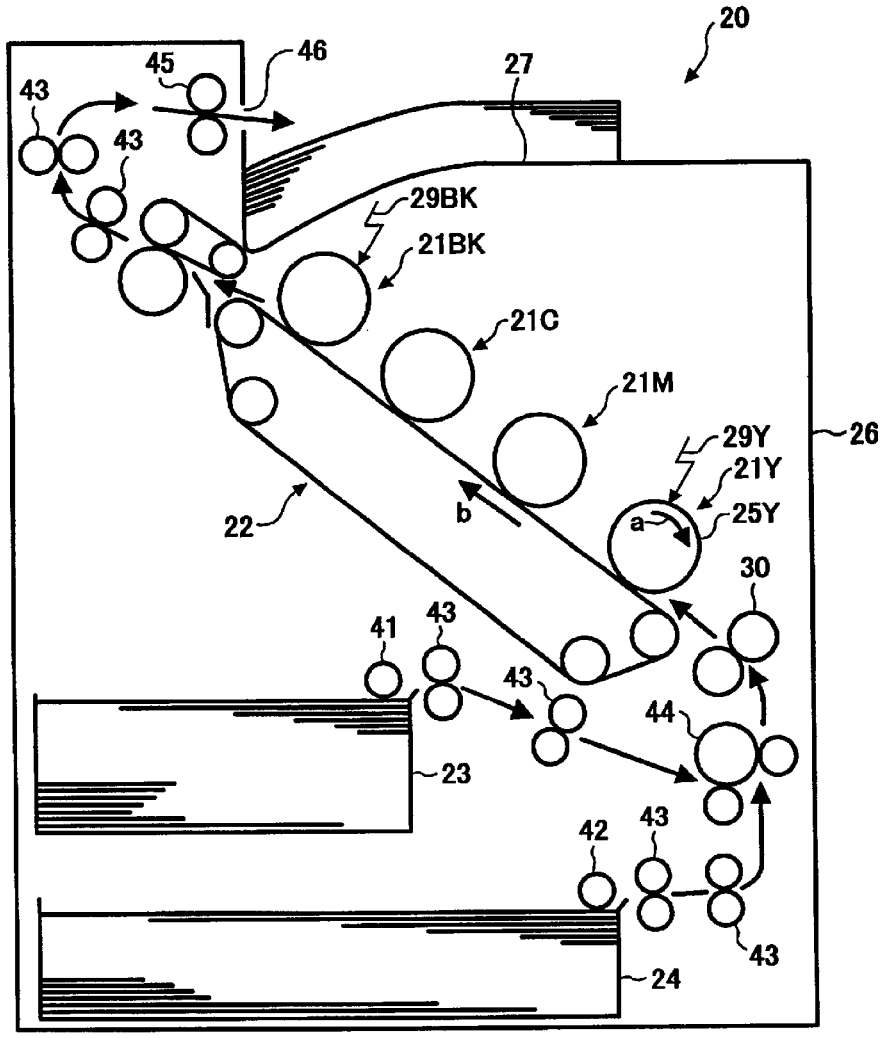
FIG. 1 is a schematic drawing illustrating a construction of an image forming apparatus according to an example of the present invention.

Referring now to the drawings, wherein like reference numerals designate identical or corresponding parts throughout the several views, an example of the present invention is described below referring to the figures. FIG. 1 is a schematic drawing illustrating a construction of an image forming apparatus 20 to be used in a copying machine or a printer capable of forming a full color image. The image forming apparatus 20 can also be used in a facsimile machine that forms an image like the above-described copying machine and printer. The facsimile machine forms the image based on a received image signal. The image forming apparatus 20 can also be used in a copying machine, printer, and facsimile machine that form a single color image.

The image forming apparatus 20 includes image forming devices 21Y, 21M, 21C, and 21BK, and a transfer device 22 arranged at a position opposed to the image forming devices 21Y, 21M, 21C, and 21BK. The image forming apparatus 20 further includes sheet feeding cassettes 23 and 24, a registration roller 30, and a fixing device 1. The sheet feeding cassettes 23 and 24 feed various types and sizes of sheet-like recording media to a transfer region formed at a position where the transfer device 22 opposes the respective image forming devices 21Y, 21M, 21C and 21K. The registration roller 30 feeds the sheet-like recording medium conveyed from the sheet feeding cassettes 23 and 24 to the transfer region by adjusting a time, such that the sheet-like recording medium is in precise register with images formed by the image forming devices 21Y, 21M, 21C and 21BK.

In the, image forming apparatus 20, either a normal recording medium or a special recording medium may be used. The normal recording medium includes, for example, a plain paper that is generally used in a copier, (hereinafter referred to as a normal recording medium). The special recording medium includes, for example, an overhead transparency film sheet, a card, a postcard, a thick paper having a basis weight of about 100 g/m2 or greater, and an envelope (hereinafter referred to as a special recording medium). The special recording medium generally has a larger thermal capacity than that of the normal recording medium.

The image forming devices 21Y, 21YM, 21C, and 21BK form yellow, magenta, cyan, and black-and-white toner images, respectively. Because their configurations are substantially the same except for the color of toner to be used, the configuration of the image forming device 21Y is described below as an example of each of the image forming devices. The image forming device 21Y includes a photoconductive drum 25Y as an electrostatic latent image bearing member. A commonly known charging device, developing device, cleaning device, and so forth (not shown) are arranged around the photoconductive drum 25Y in the order of the rotating direction of the photoconductive drum 25Y indicated by arrow "a". A surface of the photoconductive drum 25Y is exposed to an exposure light 29Y emitted from a scanning device (not shown) including a polygon mirror which is provided between the charging device and developing device. A belt-shaped photoconductive element may be employed as the electrostatic latent image bearing member instead of the drum-shaped photoconductive element. In the image forming device 21BK, two beam lights 29BK are emitted such that an image is formed more quickly as compared to an image forming operation performed in the other image forming devices 21Y, 21M, and 21C.

A-4 size and A-3 size sheet-like recording media, for example, are longitudinally loaded in a horizontal direction in FIG. 1 in the sheet feeding cassettes 23 and 24, respectively. The transfer device 22 is arranged in an oblique direction such that the size of the image forming apparatus 20 is minimized in the horizontal direction in FIG. 1. Thus, the sheet-like recording medium is conveyed in the oblique direction as indicated by an arrow "b". With this arrangement, a width of a housing 26 is reduced to a size which is slightly greater than the longitudinal length of the A-3 size sheet-like recording medium. Thus, the size of the image forming apparatus 20 is minimized such that it has a minimum necessary size to contain the sheet-like recording medium inside. A sheet discharge tray 27 is formed in the top surface of the housing 26 to stack the sheet-like recording medium having a toner image fixed by the fixing device 1.

In FIG. 1, reference numerals 41 and 42 denote pickup rollers that feed the sheet-like recording media from the sheet feeding cassettes 23 and 24, respectively. Reference numerals 43 and 44 each denote a conveying roller conveying the sheet-like recording medium and a roller mechanism which feeds the sheet-like recording medium conveyed from the sheet feeding cassettes 23 and 24 to the registration roller 30. Reference numeral 45 denotes a discharging roller to discharge the sheet-like recording medium to the sheet discharge tray 27 from a sheet discharging outlet 46.

Figure 2:
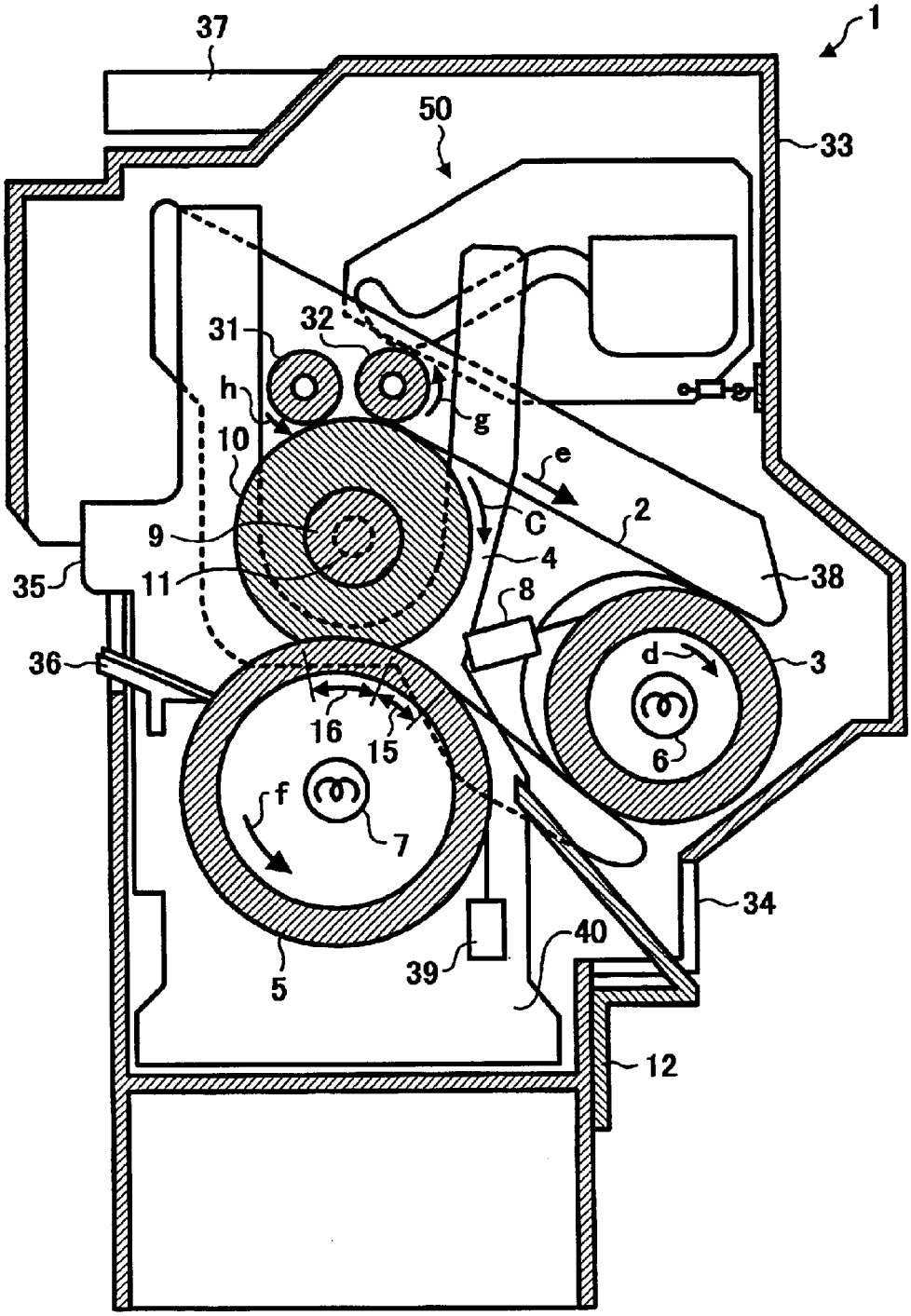
FIG. 2 is a schematic drawing illustrating a construction of a fixing device according to an example of the present invention.

As illustrated in FIG. 2, the fixing device 1 includes an endless fixing belt 2, a heating roller 3, a fixing roller 4, a pressure roller 5, heaters 6 and 7, and a thermistor 8. The endless fixing belt 2 (i.e., a sheet-like recording medium conveying member) conveys the sheet-like recording medium for fixing a toner image thereon. The fixing belt 2 is spanned around the heating roller 3. The pressure roller 5 is arranged at a position opposed to the fixing roller 4 via the fixing belt 2. The heaters 6 and 7 are provided inside the heating roller 3 and pressure roller 5, respectively. The thermistor 8 is arranged at a position opposed to the heating roller 3 to abut against the heating roller 3. The thermistor 8 (i.e., a temperature detecting device) detects a temperature of the heating roller 3. The fixing device 1 further includes a cleaning roller 31, a coating roller 32, a release agent supplying device so, a casing 33, an inlet guide 12, an outlet guide 36, a handle 37, and a supporting member 38. The cleaning roller 31 is provided opposite to the fixing roller 4 via the fixing belt 2. The coating roller 32 (i.e., a release agent coating member) coats a release agent. The release agent supplying device 50 supplies the coating roller 32 with a release agent. The inlet guide 12, outlet guide 36, and handle 37 are fixedly provided on the casing 33. The supporting member 38 integrally supports the heating roller 3, fixing roller 4, and the fixing belt 2. In addition, a supporting member 40 that supports the supporting member 38 and pressure roller 5 with respect to the casing 33 is arranged. It is preferable that the thermistor 8 detects the temperature of the heating roller 3 at a position where the heating roller 3 is in press-contact with the fixing belt 2. However, because the thermistor 8 is not m provided at such position, the thermistor 8 is provided to detect the temperature of the heating roller 3 at a position where the heating roller 3 is not in press-contact with the fixing belt 2, in which the temperature of the heating roller 3 is approximately equal to that of the heating roller 3 that is in press-contact with the fixing belt 2.

In order to give a predetermined suitable tension on the fixing belt 2, the heating roller 3 is biased in a direction away from the fixing roller 4 by a resilient member (not shown), such as a spring. The fixing roller 4 includes a core metal 9 and a heat-resistant elastic layer 10 which covers the core metal 9. A shaft 11 is rotatably driven by a driving device (not shown). Thus, the fixing roller 4 is rotatably driven in a direction indicated by an arrow "c". The fixing roller 4 rotatably drives the heating roller 3 in a direction indicated by an arrow "d", thereby driving the fixing belt 2 in a direction indicated by an arrow "e". Thus, the pressure roller 5 and coating roller 32 rotate in directions indicated by arrows "e" and "e", respectively, with the movement of the fixing belt 2.

The supporting members 38 and 40 are biased in a direction such that they are brought closer together by a resilient member (not shown), such as a spring. Thus, the pressure roller 5 and the fixing roller 4 are biased in a direction of press-contacting each other with a pressing force of equal to 10 kgf or greater. The pressure roller 5 is in press-contact with the fixing roller 4 such that an angle formed between a line connecting the shaft centers of the fixing roller 4 and the heating roller 3 and a line connecting the shaft centers of the fixing roller 4 and the pressure roller 5 is an acute angle. With this arrangement, two fixing regions, i.e., first and second fixing regions 15 and 16, are formed in a fixing area where a toner image is fixed onto a sheet-like recording medium. In the first fixing region 15, the pressure roller 5 does not contact the fixing roller 4, but contacts the fixing belt 2. In the second fixing region 16, the pressure roller 5 is in press-contact with the fixing roller 4 via the fixing belt 2.

The casing 33 is provided at a position opposed to the transfer device 22. The casing 33 includes an inlet 34 and an outlet 35. The inlet 34 receives a sheet-like recording medium conveyed from the transfer device 22. The outlet 35 is arranged at the opposite side of the inlet 34 having the first and second fixing regions 15 and 16 therebetween. The sheet-like recording medium onto which a toner image has been fixed is discharged from the outlet 35. The base of the inlet guide 12 is fixed to the external surface of the casing 33 in the downward direction of the inlet 34. A tip portion of the inlet guide 12 goes into the inside of the casing 33 from the inlet 34 and is extended toward the first fixing region 15.

The fixing belt 2 includes a base member of 100 $\mu$m in thickness made of nickel, and a releasing layer of 200 $\mu$m in thickness made of silicone rubber layered on the base member. The fixing belt 2 has a low thermal capacity and a suitable thermo-response. The length of the fixing belt 2 is set such that the diameter is 60 mm when the fixing belt 2 is made into a circle. The base member may be made of stainless steel or polyimide. The thickness of the base member may be in a range of about 30 $\mu$m to about 150 $\mu$m considering its flexibility. When silicone rubber is employed for the releasing layer, the thickness of the releasing layer is preferably in a range of about 50 $\mu$m to about 300 $\mu$m. When fluororesin is employed for the releasing layer, the thickness of the releasing layer is preferably in a range of about 10 $\mu$m to about 50 $\mu$m. If the thickness of the releasing layer is large, a thermal capacity of the fixing belt 2 is increased, resulting in a long warm-up time or production of an adverse effect on a fixing operation. The releasing layer may have an alternative structure in which fluororesin is layered on silicone rubber. The above-described conditions are set so that the fixing belt 2 has a low thermal storage capacity. Namely, the fixing belt 2 is required to have a property such that the fixing belt 2 is quickly heated up and the surface of the fixing belt 2 is self-cooled in the fixing region without causing a hot offset problem in which a part of a fused toner image adheres to the fixing belt 2. On the other hand, the fixing belt 2 is required to have a thermal capacity necessary for fusing and fixing a toner image on a sheet-like recording medium in the fixing region. The above-described material and thickness of the fixing belt 2 meets such required conditions. The self-cool of the fixing belt 2 includes a phenomenon in which the fixing belt 2 cools in a fixing operation in the fixing region because no heating source is provided at a side of a surface of a sheet-like recording medium on which an unfixed image is carried.

Because the heating roller 3 and the fixing roller 4 are biased in a direction in which the heating roller 3 and the fixing roller 4 are moving away from each other, the fixing belt 3 is tensioned with about 3 Kgf. The tension on the fixing belt 2 is adjusted by changing the biasing force of the resilient member (not shown). The tension on the fixing belt 2 may be preferably set in a range of about 1 Kgf (9.8 N) to about 3 Kgf (29.4 N) for a proper toner image fixing operation.

The heating roller 3 and the pressure roller 5 each includes hollow cylindrical core metals such that they provide a low thermal capacity. The diameter of the core metal of the heating roller 3 is preferably set at a value which is greater than or equal to 20 mm and less than or equal to 30 mm, and the thickness of the core metal thereof is set at a value which is greater than or equal to 0.3 mm and less than or equal to 2.0 mm. The diameter of the core metal of the pressure roller 5 is preferably set at a value which is greater than or equal to 30 mm and less than or equal to 50 mm, and the thickness of the core metal thereof is set at a value which is greater than or equal to 0.3 mm and less than or equal to 1.5 mm. Thus, the thermal capacity of the heating roller 3 is set to approximately 26 cal/° C. or less, and the thermal capacity of the pressure roller 5 is set to approximately 36 cal/° C. or less.

In this example of the present invention, the core metal of the heating roller 3 is made of aluminum. The diameter of the core metal of the heating roller 3 is set to 30 mm and the thickness thereof is set to 0.7 mm. The material of the core metal preferably has a low specific heat and high thermal conductivity. In place of aluminum, other metals, such as iron, copper, stainless steel, etc., may be employed. For example, when the diameter of aluminum core metal of the heating roller is 30 mm, the thickness of the core metal may be set in a range of about 0.6 mm to about 1.4 mm. When the diameter of iron core metal of the heating roller 3 is 20 mm, the thickness of the core metal may be set in a range of about 0.7 mm to about 1.4 mm. When the diameter of iron core metal of the heating roller 3 is 30 mm, the thickness of the core metal may be set in a range of about 0.3 mm to about 0.9 mm. The reason why the thickness of the core metal is made smaller as the diameter thereof is increased is that the distortion of the heating roller 3 in the axial direction thereof is obviated.

The above-described lower limit value of the thickness of the core metal represents an allowable level of value to obviate a deformation of the heating roller 3 caused by the above-described tension of the fixing belt 2. The higher limit value of the thickness of the core metal of the heating roller 3 represents an allowable level of value to accomplish a desired warm-up time. The reason why the diameter of the core metal is set to 20 mm or larger is that the required tension of the fixing belt 2 is maintained and that the distortion of the heating roller 3 in the axial direction thereof is obviated. Further, the reason why the diameter of the core metal is set in the range of about 20 mm to about 30 mm is to have the thermal capacity of about 26 cal/° C. so as to maintain the fixing belt 2 at a constant temperature required for a fixing operation even when a continuous fixing operation is performed with a conveying speed of a sheet-like recording medium at less than or equal to 200 mm/s. It is preferable not to employ the heating roller 3 having the core metal of more than 30 mm in diameter. Because the thermal capacity of the heating roller 3 increases as the diameter of the core metal increases, a long period of time is required for a warm-up operation.

When the heating roller 3 has a low thermal capacity, the heating roller 3 does not largely absorb heat from the fixing belt 2 even when the fixing belt 2 is rotated, thereby preventing adverse effects on a fixing performance and preventing the requirement of a longer period of time for a warm-up operation. In addition, even if the temperature is decreased, for example, by a continuous fixing operation, the time required to recover the temperature is shortened. The heater 6 heats the heating roller 3 and the fixing belt 2 via the heating roller 3. A temperature of the heater 6 is input to a controller (not shown) as a signal detected by the thermistor 8. The input temperature is compared with a set temperature. When the detected temperature is lower than the set temperature, energization of the heater 6 is performed. When the detected temperature is higher than the set temperature, the energization of the heater 6 is stopped. Thus, the fixing temperature of the heating roller 3 is controlled based on the detection of the thermistor 8, and the surface temperature of the fixing belt 2 is maintained at 110° C. or higher. The thermistor 8 abuts against the heating roller 3 with an obtuse angle in the rotating direction of the heating roller 3 so as to reduce abrasion caused by friction between the thermistor 8 and the heating roller 3 produced when the heating roller 3 is rotated.

Because both the heating roller 3 and pressure roller 5 are configured to have a low thermal capacity, a temperature of the heating roller 3 and pressure roller 5 quickly changes. Thus thermistors having fast responsivities are employed as the thermistors 8 and as a thermistor 39 to respond the quick change of the temperature of the heating roller 3 and pressure roller 5. It is preferable not to provide a heat absorbing member (for example, a releasing agent coating device or cleaning device) to the heating roller 3 or a portion of the fixing belt 2 that windingly contacts the heating roller 3 (i.e., in a heating position) so that heat of the heating roller 3 is quickly transferred to the fixing belt 2.

The elastic layer 10 of the fixing roller 4 includes a rubber layer made of rubber. More specifically, the material of the rubber of the rubber layer is silicone sponge rubber in the form of a foam. A bubble diameter is set to 500 μm. The diameter of the bubble in the vicinity of the surface of the fixing roller 4, i.e., in the vicinity of the four periphery planes of the fixing roller 4, is set to 300 μm or less. Because the elastic layer 10 is in the form of a foam, a reduction in the temperature of the fixing operation is suppressed. Inconvenience, such as an unsatisfactory glossy finish due to an insufficient fixing pressure, an uneven glossy finish due to surface roughness, etc., may be caused because the elastic layer 10 is in the form of a foam. However, such inconvenience is obviated by arranging the diameter of the bubble as described above. A non-form layer (i.e., a so-called "skin layer"), having the thickness of about 1 mm, may be formed on the surface of the elastic layer 10.

The surface hardness of the elastic layer 10 is set to 20 HS or greater when measured by an "ASKER C" method (i.e., a method of measuring a hardness). When the surface hardness of the elastic layer 10 is equal to 20 HS or greater, the surface roughness of the elastic layer 10 due to the foam does not affect image quality regardless of whether the elastic layer 10 includes the skin layer or not. Thus, a satisfactory image is produced without having an uneven glossy finish. The outer diameter of the fixing roller 4 is set to 30 mm. The elastic layer 10 includes a heat-resistant and porous elastic member having low thermal conductivity. Thus, the fixing roller 4 does not largely absorb heat from the fixing belt 2, thereby minimizing a decrease in the temperature of the fixing belt 2 after the warm-up operation is completed. Further, a period of time required for a pre-rotation of the fixing belt 2 to recover the temperature is reduced. Because the elastic layer 10 has a comparatively low hardness, a sufficient nip width is secured even if a pressing force of the pressure roller 5 is small. Thus, a high fixing performance is accomplished even under a low-temperature and low-pressure condition.

The core metal of the pressure roller 5 is made of iron. The diameter of the core metal of the pressure roller 5 is set to 40 mm and the thickness thereof is set to 1.0 mm. The material of the core metal preferably has a low specific heat and high thermal conductivity. Other metals, such as aluminum, copper, stainless steel, etc., may be employed in place of iron. For example, when the diameter of iron core metal of the pressure roller 5 is 30 mm, the thickness of the core metal may be set in a range of about 0.4 mm to about 11.0 mm. When the diameter of iron core metal of the pressure roller 5 is 50 mm, the thickness of the core metal may be set in a range of about 0.3 mm to about 0.8 mm. When the diameter of aluminum core metal of the pressure roller 5 is 30 mm, the thickness of the core metal may be set in a range of about 1.3 mm to about 1.5 mm. When the diameter of aluminum core metal of the pressure roller 5 is 50 mm, the thickness of the core metal may be set in a range of about 0.6 mm to about 1.2 mm. The reason why the thickness of the core metal is made smaller as the diameter thereof is increased is that the distortion of the pressure roller 5 in the axial direction thereof is prevented.

The above-described lower limit value of the thickness of the core metal represents an allowable level of value to prevent a deformation of the pressure roller 5 caused by the pressure of 0.6 Kg/cm2 corresponding to the lower limit value of the fixing pressure. The higher limit value of the thickness of the core metal of the pressure roller 5 represents an allowable level of value to accomplish a desired warm-up time. The reason why the diameter of the core metal is set to 30 mm or larger is that the required fixing m=pressure is maintained and that the distortion of the pressure roller 5 in the axial direction thereof is prevented. Further, the reason why the diameter of the core metal is set in the range of 30 mm to 50 mm is to a have a thermal capacity of about 26 cal/° C. so as to maintain the fixing belt 2 at a constant temperature required for a fixing operation even when a continuous fixing operation is performed.

When the pressure roller 5 has a low thermal capacity, the pressure roller 5 does not largely absorb heat from the fixing belt 2 even when the fixing belt 2 is rotated. According to the example of the present invention, the pressure roller 5 includes the heater 7, thereby preventing ill effects exerted on a fixing performance due to a decrease in the temperature of the fixing belt 2 and a longer period of time required for the warm-up operation is prevented. Further, even if the temperature is decreased, for example, by the continuous fixing operation, the time required to recover the temperature is shortened. The heater 7 heats the pressure roller 5 to shorten the warm-up time and supplies heat to the underside of a sheet-like recording medium in a fixing operation to achieve a stable fixing performance. In addition, the pressure roller 5 may include a releasing layer in a range of about 10 μm to about 300 μm in thickness layered on the core metal. The heater 7 heats the pressure roller 5. The thermistor 39 detects a temperature of the pressure roller 5 and inputs the detected temperature to a controller (not shown) in a form of a signal. The detected temperature is compared with a set temperature. Energization of the heater 7 is started when the detected temperature is lower than the set temperature. Conversely, the energization of the heater 7 is stopped when the detected temperature is higher than the set temperature. Thus, the temperature of the pressure roller 5 is controlled to maintain a surface temperature of the pressure roller 5 at greater than or equal to 110° C. The thermistor 39 abuts against the pressure roller 5 with an obtuse angle in the rotating direction of the pressure roller 5 so as to reduce abrasion caused by friction between the thermistor 39 and the pressure roller 5 produced when the pressure roller 5 is rotated.

The reason why the thickness of the heating roller 3 and the pressure roller 5 is minimized, such that they have a low thermal capacity, is that the fixing belt 2 is employed in the fixing device 1. Because the fixing operation is performed in the comparatively long region, i.e., in the first and second fixing regions 15 and 16, the fixing pressure is reduced, and strength of the pressure roller 5 is decreased. Further, because the pressure roller 5 does not press-contact with the heating roller 3, the thickness of the heating roller 3 and the pressure roller 5 is kept to a minimum. As described above, because the fixing operation is performed in the comparatively long region, the fixing operation is performed with a comparatively low temperature, thereby reducing the period of time required for the warm-up operation. Further, when the fixing belt 2 is employed, the fixing belt 2, which is heated by a heater, is cooled down to a suitable temperature for the fixing operation while the fixing belt 2 is rotated, thereby preventing a hot offset problem.

The cleaning roller 31 is arranged at a position adjacent to the coating roller 32 while the cleaning roller 31 is positioned at an upstream side of the coating roller 32 in the moving direction of the fixing belt 2. Both the cleaning roller 31 and the coating roller 32 abut against the fixing belt 2. The cleaning roller 31 and coating roller 32 are rotated by a w driving device (not shown) in directions indicated by arrows "h" and "g", respectively. Namely, the cleaning roller 31 and coating roller 32 are rotated at a position opposed to the fixing belt 2 in the same direction and at the same speed in which the fixing belt 2 moves. The cleaning roller 31 abuts against the fixing belt 2 to wipe toner transferred onto the fixing belt 2 from the sheet-like recording medium. Thus, a surface of the fixing belt 2 is kept clean. The coating roller 32 applies a predetermined amount of release agent, which is supplied from the release agent supplying device 50, to the fixing belt 2. A main component of the release agent is silicone oil. A contact/separation mechanism (not shown) controls a contact and separation operation of the release agent supplying device 50 with and from the fixing belt 2 so that the predetermined amount of release agent is applied to the fixing belt 2.

As described above, the heater 6 and thermistor 8 are provided to the heating roller 3. The heater 6 heats the underside of the fixing belt 2. The thermistor 8 controls the heater 6. Similarly, the heater 7 and thermistor 39 are provided to the pressure roller 5. The heater 7 heats the surface of the fixing belt 2. The thermistor 39 controls the heater 7. The heating roller 3 and pressure roller 5 each includes a cylindrical-shaped core metal having a low thermal capacity. Thus, the heating roller 3 and pressure roller 5 quickly respond to an off/off operation of the heaters 6 and 7. Hence, even if the thermistors 8 and 39 detect that a respective temperature of the heating roller 3 and pressure roller 5 exceeds a predetermined set temperature and stop energization of the heaters 6 and 7, it may happen that the heating roller 3 and pressure roller 5 are heated to a temperature that is higher than the predetermined set temperature. When the heating roller 3 is heated to the temperature that is higher than the predetermined set temperature, the surface of the fixing belt 2 is excessively heated. The above-described phenomenon likely occurs when a surface temperature of the fixing belt 2 and pressure roller 5 is decreased below the predetermined set temperature because a heat capacity is transferred to a sheet-like recording medium such as a transfer sheet from the fixing belt 2 and pressure roller 5 when the sheet-like medium passes through a fixing region. Namely, when the surface temperature of the heating roller 3 is increased from 150° C. to 170° C. (e.g., set temperature), the heating roller 3 is heated to a temperature higher than the temperature when the surface temperature of the heating roller 3 is increased from 165° C. to 170° C.

Figure 3A:
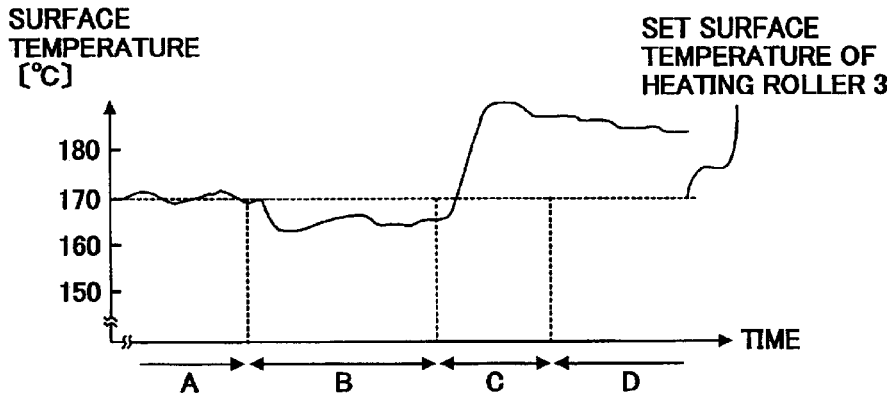
FIG. 3A PRIOR ART
FIGS. 3A and 3B are diagrams illustrating a change in a surface temperature of a conventional heating roller and pressure roller, respectively.
Figure 3B:
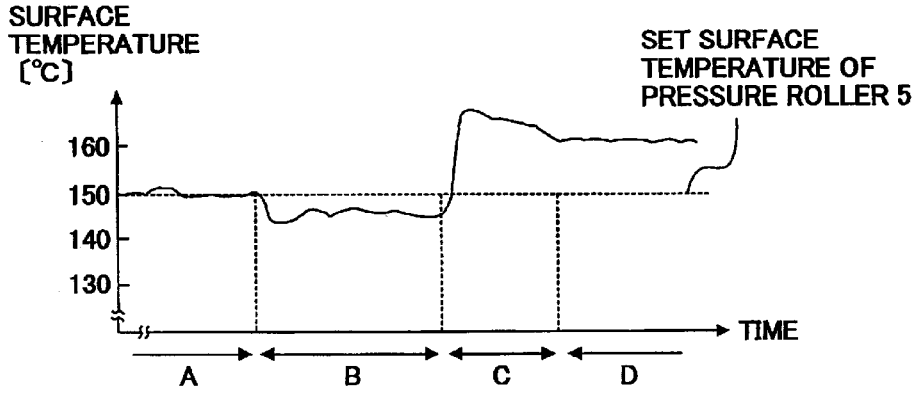
FIG. 3B PRIOR ART

FIGS. 3A and 3B are diagrams illustrating a change in a surface temperature of the conventional heating roller 3 and pressure roller 5, respectively. According to the example of the present invention, a difference in the surface temperature between the heating roller 3 and fixing belt 2 is set at 20° C. Thus, the set surface temperature of the heating roller 3 and pressure roller 5 is set to 170° C. and 150° C., respectively, to have a difference in the set temperature by 20° C. The periods of time indicated by "A", "B", "C", and "D" respectively represent; "A": the apparatus is in a state of a pre-rotation before a sheet-like recording 4 medium is conveyed to the fixing region. "B": the sheet-like recording medium is being conveyed through the fixing region. In this example, three sheet-like recording media are conveyed through the fixing region in sequence as a series of a job. "C": the third sheet-like recording medium (i.e., last sheet-like recording medium) has been conveyed through the fixing region, however, the driving mechanism of the apparatus is driven to discharge the sheet-like recording medium to the sheet discharging tray 27 provided on the top of the housing 26. Thus, the fixing device 1 keeps on rotating. "D": the sheet-like recording medium is discharged to the sheet discharging tray 27 and the fixing device 1 stops the operation.

Whether or not the sheet-like recording medium has passed through the fixing region (i.e., nip region) is determined based on data on a conveying speed and length of the sheet-like recording medium, and a detection of a trailing edge of the sheet-like recording medium performed by a registration sensor (not shown) provided at an upstream side of the fixing device 1. The sensor may be provided to a position close to the nip region to detect the trailing edge of the sheet-like recording medium. In other methods, whether or not the sheet-like recording medium has passed through the nip region is determined based on data on a conveying speed and length of the sheet-like recording medium, and a detection of a leading edge of the sheet-like recording medium performed by the sensor (not shown) provided at a downstream side of the outlet guide 36. If the conveying speed of the sheet-like recording medium is not extremely slow, and a distance between the nip region and the sensor provided at the downstream side of the outlet guide 36 is short, it may be determined that the sheet-like recording medium has passed through the nip region when the sensor detects the trailing edge of the sheet-like recording medium.

The surface temperature of the heating roller 3 is maintained at 170° C. in the period of time A, however, in the period of time B, the surface temperature of the heating roller 3 temporarily decreases by about 5° C. because an amount of heat is absorbed by a sheet-like recording medium. The heater 6 is then turned on. The surface temperature of the heating roller 3 starts to increase in the period of time C because the sheet-like recording medium has passed through a fixing region. When the thermistor 8 detects that the surface temperature of the heating roller 3 is higher than the set surface temperature, the heater 6 is turned off. However, due to a slow responsivity of the heater 6, the surface temperature of the heating roller 3 exceeds the controlled surface temperature. In the period of time D, the surface temperature of the heating roller 3 is maintained at a temperature that is higher than the set surface temperature by 10° C. or more because the fixing device 1 stops the operation and the heat of the heating roller 3 is not absorbed by the fixing belt 2.

Similarly, the surface temperature of the pressure roller 5 is maintained at 150° C. in the period of time A, however, in the period of time B, the surface temperature of the pressure roller 5 w temporarily decreases by about 5° C. because an amount of heat is absorbed by a sheet-like recording medium. The heater 7 is then turned on. Because the thermistor 39 is provided to a position that is closer to the nip region than the thermistor 8, the heater 7 is quickly turned on compared to the heater 6 of the heating roller 3. Thus, the surface temperature of the pressure roller 5 quickly increases compared to that of the heating roller 3. The surface temperature of the pressure roller 5 starts to increase in the period of time C because the sheet-like recording medium has passed through a fixing region. When the thermistor 39 detects that the surface temperature of the pressure roller 5 is higher than the set surface temperature, the heater 7 is turned off. However, due to a slow responsivity of the heater 7, the surface temperature of the pressure roller 5 exceeds the controlled surface temperature. In the period of time D, the surface temperature of the pressure roller 5 is maintained at a temperature that is higher than the set surface temperature by 10 C or higher because the fixing device 1 stops the operation and the heat of the pressure roller 5 is not absorbed by the fixing belt 2. The above-described phenomenon occurs due to a heating system having a quick thermal responsivity (i.e., a temperature is quickly increased because of a low thermal capacity), and a relationship between a heating position and the most heat absorbing position even if a thermistor having a fast responsivity is employed.

Figure 4A:
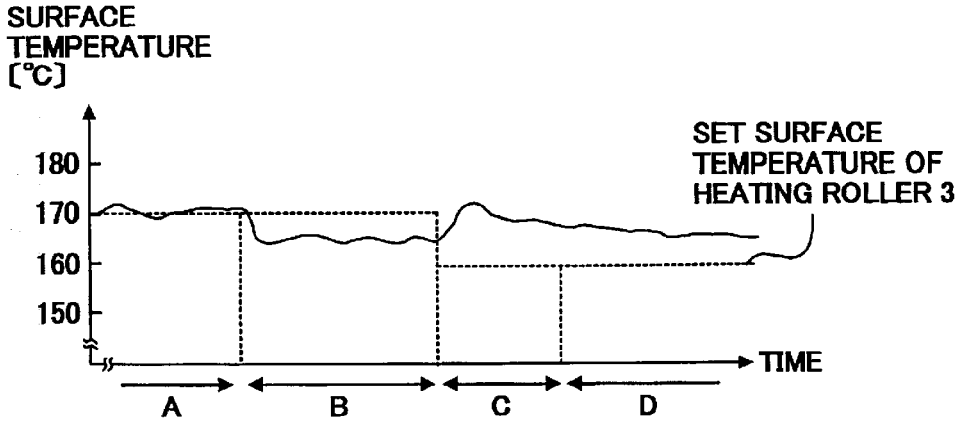
FIGS. 4A and 4B are diagrams illustrating a change in a surface temperature of a heating roller and pressure roller, respectively according to the present invention.
Figure 4B:
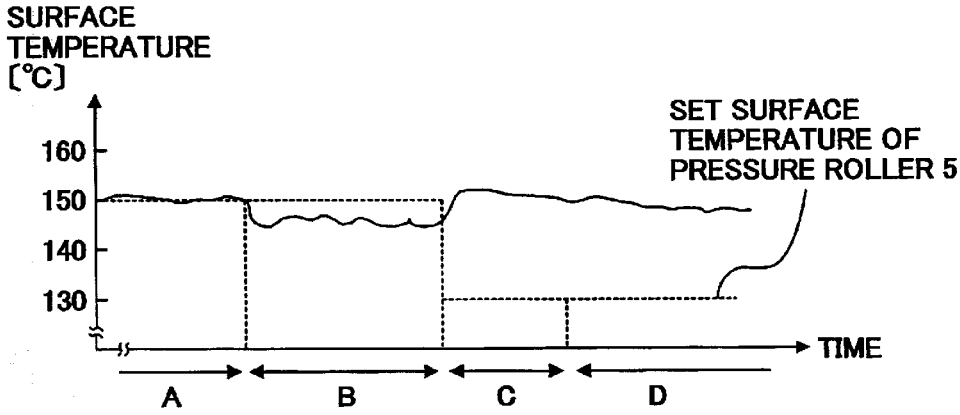

FIGS. 4A and 4B are diagrams illustrating a change in a surface temperature of the heating roller 3 and pressure roller 5, respectively according to an example of the present invention. As is the case with the conventional heating roller 3 and pressure roller 5 described referring to FIGS. 3A and 3B, a difference in the surface temperature between the heating roller 3 and fixing belt 2 is set at 20° C. Thus, the set surface temperature of the heating roller 3 and pressure roller is set to 170° C. and 150° C., respectively, to have a difference in the set temperature by 20° C. Similar to the case with the conventional heating roller 3 and pressure roller 5 described referring to FIGS. 3A and 3B, periods of time indicated by "A", "B", "C", and "D" respectively represent; "A": the apparatus is in a state of a pre-rotation before a sheet-like recording medium is conveyed to the fixing region. "B": the sheet-like recording medium is being conveyed through the fixing region. In this example, three sheet-like recording media are conveyed through the fixing region in sequence as a series of a job. "C": the third sheet-like recording medium (i.e., last sheet-like recording medium) has been conveyed through the fixing region, however, the driving mechanism of the apparatus is driven to discharge the sheet-like recording medium to the sheet discharging tray 27 provided on the top of the housing 26. Thus, the fixing device 1 keeps on rotating. "D": the sheet-like recording medium is discharged to the sheet discharging tray 27 and the fixing device 1 stops the operation. Whether or not the sheet-like recording medium has passed through the fixing region (i.e., nip region) is determined by the above-described methods.

The surface temperature of the heating roller 3 is maintained at 170° C. in the period of time A, however, in the period of time B, the surface temperature of the heating roller 3 temporarily decreases by about 5° C. because an amount of heat is absorbed by a sheet-like recording medium. The heater 6 is then turned on.

According to the example illustrated in FIG. 4A, the set surface temperature of the heating roller 3 decreases by 10 C at the same time when the time has elapsed to reach the period of time C. Though the sheet-like recording medium that absorbs heat of the heating roller 3 has passed through a fixing region, the increase of the surface temperature of the heating roller 3 above the set surface temperature is minimized due to the decrease in the set surface temperature by 10° C. Thus, the surface temperature of the heating roller 3 is maintained approximately at a desired fixing temperature (i.e., 170° C.). Even though the fixing device 1 stops the operation in the period of time D, the surface temperature of the heating roller 3 is maintained approximately at the desired fixing temperature. In the period of time C, the heater 6 is turned off because the set surface temperature is decreased below the surface temperature of the heating roller 3. However, the surface temperature of the heating roller 3 increases. This phenomenon occurs because heat of the heating roller 3 is not absorbed by a sheet-like recording medium in the period of time C, and a slow responsivity of the heater 6 (i.e., even though power supply is stopped, a heat generation is not immediately stopped).

Similarly, the surface temperature of the pressure roller 5, is maintained at 150° C. in the period of time A. However, in the period of time B, the surface temperature of the pressure roller 5 temporarily decreases by about 5° C. because an amount of heat is absorbed by a sheet-like recording medium. The heater 7 is then turned on. According to the example illustrated in FIG. 4B, the set surface temperature of the pressure roller 5 decreases by 20° C. at the same time when the time has elapsed to reach the period of time C. This is due to the fact that an amount of change in the temperature of the pressure roller 5 is smaller than that of the heating roller 3, because a release layer having a thickness of 200° $\mu$m is formed around a core metal of the pressure roller 5. Thus, the pressure roller 5 has a thermal capacity of not greater than 36 cal/° C. while the heating roller 3 has the thermal capacity of not greater than 26 cal/° C. Though the sheet-like recording medium that absorbs heat of the pressure roller 5 has passed through a fixing region, the increase of the surface temperature of the pressure roller 5 above the set surface temperature is minimized due to the decrease in the set surface temperature by 20° C. Thus, the surface temperature of the pressure roller 5 is maintained approximately at a desired fixing temperature (i.e., 150° C.). Even though the fixing device 1 stops the operation in the period of time D, the surface temperature of the pressure roller 5 is maintained approximately at the desired fixing temperature. In the period of time C, the surface temperature of the fixing belt 2 is not entirely uniform if the period of time C is short. Namely, the surface of the fixing belt 2 includes a portion where the temperature is high and portion where the temperature is low. The fixing belt 2 stops the rotation in the period of time D. At this time, a difference in the temperature between the portion where the temperature is high and portion where the temperature is low is decreased if the fixing belt 2 is configured to stop in the following manner. Namely, The high temperature portion of the fixing belt 2 is positioned at the nip region and low temperature portion of the fixing belt 2 is positioned at the heating position. The high temperature portion of the fixing belt 2 corresponds to a portion of the fixing belt 2 positioned between the heating position and just before the nip region when the last sheet-like recording medium passes through the nip region. The low temperature portion of the fixing belt 2 corresponds to a portion of the fixing belt 2 positioned between the nip region and just before the heating position when the last sheet-like recording medium passes through the nip region. This arrangement is advantageous when no heater is provided to a pressure roller or a set temperature of the heater provided inside the pressure roller is low. The above-described arrangement is controlled based on data on a predetermined length of a fixing belt and a detection of a passing of a sheet-like recording medium through the nip region. If the apparatus is not configured such that both high and low temperature portions of the fixing belt 2 are positioned at the nip region and heating position, respectively due to layout, the apparatus may be configured such that at least the high or low portion of the fixing belt 2 is positioned at the nip region or heating position.

Because an excessive increase of a temperature of the heating roller 3 and pressure roller 5 that happens after a sheet-like recording medium has passed through a fixing region is prevented, a hot offset phenomenon and an occurrence of a malfunction of an excessive temperature increase inhibiting device are prevented. Although the set surface temperature of the heating roller 3 and pressure roller 5 is decreased by 10° C. and 20° C., respectively, when the last sheet-like recording medium has passed through the fixing region, the set surface temperature of the heating roller 3 and pressure roller 5 is increased to respective predetermined set temperatures before a sheet-like recording medium for a following image forming operation is conveyed to the image forming device 21BK which is disposed at a position nearest to the fixing device 1. Thus, the following image forming operation is not affected.

Figure 5:
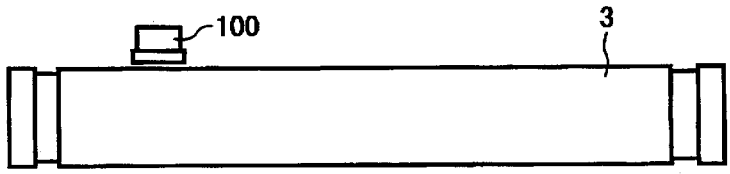
FIG. 5 is a schematic drawing illustrating an excessive temperature increase inhibiting device.

As illustrated in FIG. 5, the heating roller includes a thermostat 100 as an excessive temperature increase inhibiting device. The thermostat 100 stops energization of the heater 6 when the heating roller 3 is heated above a predetermined temperature to prevent smoking or firing of the heating roller 3. The thermostat 100 is provided to the supporting member 38 such that the thermostat 100 contacts the heating roller 3. The thermostat 100 stops the energization of the heater 6 when the heating roller 3 is heated to 200° C. and above. According to the discussion described above, the set surface temperature of the heating roller 3 is set at 170° C., however, the set surface temperature of the heating roller 3 is adjustable to 180° C. for a thick sheet-like recording medium. Thus, if the set surface temperature of the heating roller 3 is set to 180° C., the surface temperature of the heating roller 3 may increase to about 200° C. by a conventional method. Then, it happens that the thermostat 100 is damaged and a service technician replaces it with a new one. According to the example of the present invention, an excessive temperature increase of the heating roller 3 is prevented as described above. Thus, the excessive temperature increase inhibiting device properly functions, resulting in providing a safe image forming apparatus.

In addition, if a thermal fuse is used, costs of excessive temperature increase inhibiting device is reduced. According to the example of the present invention, the heater 7 is provided inside the pressure roller 5, however, the pressure roller 5 without the heater 7 may be employed. If the pressure roller 5 having the heater 7 inside is employed, control of the heater 7 may be exerted in a manner slightly different from that described above. It is preferable that a temperature of the fixing belt 2 is controlled such that the temperature is not excessively increased or decreased. Thus, the inventor of the present invention understands that it may be the most preferable that the heater 7 of the pressure roller 5 is controlled in the same manner in which the heater 6 of the heating roller 3 is controlled as described in the example of the present invention. In the example of the present invention, the heating roller 3 is rotatably provided in a loop of the fixing belt 2 such that the heating roller 3 rotates together with a rotation of the fixing belt 2. However, the heating roller 3 may be fixedly provided such that the heating roller 3 does not rotate (i.e., the fixing belt 2 slidingly contacts the heating roller 3). The heating roller 3 may be positioned directly above the fixing roller 4 such that the second fixing region 15 is not formed. An electromagnetic induction system may be employed as a heating source instead of a heater. The temperature detection device may be provided to contact the surface of the fixing belt 2 in the heating position instead of providing it to contact the heating roller 3. However, it is preferable to provide the temperature detection device so as to contact the heating roller 3, otherwise the temperature detection device may damage the fixing belt 2. Two rollers (i.e., the heating roller 3 and fixing roller 4) are provided in the loop of the fixing belt 2 according to the example of the present invention. However, three rollers may be provided in the loop of the fixing belt 2 without being limited to the heating roller 3 and fixing roller 4.

Obviously, numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2001-096544, filed on Mar. 29, 2001, and Japanese Patent Application No. 2002-76471, filed on March 19, 2002, and the entire contents thereof are herein incorporated by reference.

What is claimed as new and is desired to be secured by Letters Patent of the United States is:

1. An image forming apparatus comprising a fixing device, the fixing device comprising:

a rotatable endless belt;

a contacting member provided within a loop of the rotatable endless belt to contact the rotatable endless belt, the contacting member including an elastic layer;

a rotatable pressing member configured to be in press-contact with the contacting member via the rotatable endless belt to form a nip region through which a sheet-like recording medium having an unfixed image thereon is configured to pass to fix the unfixed image, the rotatable pressing member including a second elastic layer;

a heating member configured to heat the rotatable endless belt at a heating position located in a region other than the nip region;

a first detecting device configured to detect a temperature of the heating member;

a controlling device configured to control the heating member based on a detection result of the first detecting device such that a temperature of the rotatable endless belt is maintained at a predetermined temperature set for a fixing operation; and a determining device configured to determine that the sheet-like recording medium has passed through the fixing device;

wherein the controlling device is adapted to control the temperature of the heating member such that the temperature of the heating member is decreased from the temperature set for the fixing operation to a predetermined temperature when the rotatable endless belt is rotating and the determining device determines that a last sheet-like recording medium in a series of a job has passed through the fixing device.

2. The image forming apparatus according to claim 1, wherein the temperature of the heating member is decreased immediately after the last sheet-like recording medium in the series of the job has passed through the fixing device within a range in which the temperature of the heating member increases to the temperature set for the fixing operation before the sheet-like recording medium for a following image forming operation is conveyed to the fixing device.

3. The image forming apparatus according to claim 1, further comprising:

a second detecting device configured to detect a temperature of the rotatable pressing member, the rotatable pressing member including a heating source, wherein the controlling device is adapted to control the heating source of the rotatable pressing member such that the temperature of the rotatable pressing member is decreased from the temperature set for the fixing operation to the predetermined temperature after the determining device determines that the last sheet-like recording medium in the series of the job has passed through the fixing device.

4. The image forming apparatus according to claim 1, wherein the rotatable endless belt is configured to stop a rotation when a predetermined operation is performed after the last sheet-like recording medium in the series of the job has passed through the fixing device, and wherein a portion of the rotatable endless belt, corresponding to the portion of the rotatable endless belt positioned between the heating position and just before the nip region when the last sheet-like recording medium in the series of the job has passed through the fixing device, is positioned in the nip region.

5. The image forming apparatus according to claim 4, wherein a portion of the rotatable endless belt, corresponding to the portion of the rotatable endless belt positioned between the nip region and just before the heating position when the last sheet-like recording medium in the series of the job has passed through the fixing device, is positioned at the heating position.

6. The image forming apparatus according to claim 1, wherein no heat absorbing member is provided to the heating position except for the rotatable endless belt.

7. The image forming apparatus according to claim 1, wherein the temperature of the rotatable endless belt gradually decreases within the predetermined range when the sheet-like recording media successively pass through the nip region while the temperature of the rotatable endless belt is controlled to be maintained at the predetermined temperature.

8. The image forming apparatus according to claim 6, wherein the heating member including the heating source is provided within the loop of the rotatable endless belt to contact the rotatable endless belt to heat the rotatable endless belt, and wherein the controlling device controls the temperature of the rotatable endless belt based on the detection result of the detection device that detects a surface temperature of the heating member.

9. The image forming apparatus according to claim 1, wherein the rotatable endless belt is configured to stop a rotation when a predetermined operation is performed after the last sheet-like recording medium in the series of job has passed through the fixing device, and wherein a portion of the rotatable endless belt, corresponding to the portion of the rotatable endless belt positioned between the heating position and just before the nip region when the last sheet-like recording medium in the series of job has passed through the fixing device, is positioned in the nip region.

10. The image forming apparatus according to claim 9, wherein a portion of the rotatable endless belt, corresponding to the portion of the rotatable endless belt positioned between the nip region and just before the heating position when the last sheet-like recording medium in the series of job has passed through the fixing device, is positioned at the heating position.

11. The image forming apparatus according to claim 3, further comprising:

an excessive temperature increase inhibiting device is provided to at least one of the rotatable pressing member and the heating member.

12. A method of fixing an image, comprising:

providing a rotatable endless belt;

contacting a contacting member with the rotatable endless belt;

forming a nip region while contacting a rotatable pressing member with the contacting member having the rotatable endless belt therebetween;

heating the rotatable endless belt at a heating position with a heating member;

detecting a temperature of the heating member;

determining that a sheet-like recording medium has passed through a fixing device; and controlling the temperature of the heating member based on a detection result of the temperature of the heating member such that the temperature of the heating member is decreased from a temperature set for a fixing operation to a predetermined temperature when the rotatable endless belt is rotating and a passing of a last sheet-like recording medium in a series of a job is detected in the determining step.

13. The method according to claim 12, wherein the temperature of the heating member is decreased in the controlling step within a range in which the temperature of the heating member increases to the temperature set for the fixing operation before another image is fixed.

14. The method according to claim 12, further comprising:

providing a heating source to the rotatable pressing member;

detecting a temperature of the rotatable pressing member;

controlling the heating source of the rotatable pressing member such that the temperature of the rotatable pressing member is decreased from the temperature set for the fixing operation to the predetermined temperature after the passing of the last sheet-like recording medium in the series of the job is detected in the determining step.

15. The method according to claim 12, further comprising:

stopping a rotation of the rotatable endless belt after the last sheet-like recording medium in the series of the job has passed through the fixing device such that a portion of the rotatable endless belt positioned between the heating position and just before the nip region when the last sheet-like recording medium in the series of the job has passed through the fixing device is positioned in the nip region.

16. The method according to claim 15, further comprising:

positioning a portion of the rotatable endless belt positioned between the nip region and just before the heating position when the last sheet-like recording medium in the series of the job has passed through the fixing device at the heating position.

17. The method according to claim 12, further comprising:

providing no heat absorbing member to the heating position except for the rotatable endless belt.

18. The method according to claim 12, further comprising:

gradually decreasing the temperature of the rotatable endless belt within the predetermined range when the sheet-like recording medium successively pass through the nip region while the temperature of the rotatable endless belt is controlled to be maintained at the predetermined temperature.

19. The method according to claim 17, further comprising:

providing a heating member having the heating source;

heating the rotatable endless belt; and controlling the temperature of the rotatable endless belt based on the detection result of the detecting device that detects a surface temperature of the beating member.

20. The method according to claim 14, further comprising:

providing an excessive temperature increase inhibiting device to at least one of the rotatable pressing member and the heating member.

21. An image forming apparatus comprising a fixing device, the fixing device comprising:

a rotatable endless belt;

means for contacting the rotatable endless belt, the means for contacting including an elastic layer provided within a loop of the rotatable endless belt;

means for pressing the rotatable endless belt against the means for contacting to form a nip region through which a sheet-like recording medium having an unfixed image thereon is configured to pass to fix the unfixed image, the means for pressing including a second elastic layer;

means for heating the rotatable endless belt at a heating position located in a region other than the nip region;

means for detecting a temperature of the means for heating;

means for controlling the means for heating based on a detection result of the means for detecting such that a temperature of the rotatable endless belt is maintained at a predetermined temperature set for a fixing operation; and means for determining that the sheet-like recording medium has passed through the fixing device;

wherein the means for controlling is adapted to control the temperature of the means for heating such that the temperature of the means for heating is decreased from the temperature set for the fixing operation to a predetermined temperature when the rotatable endless belt is rotating and the means for determining determines that a last sheet-like recording medium in a series of a job has passed through the fixing device.

22. The image forming apparatus according to claim 21, wherein the temperature of the means for heating is decreased immediately after the last sheet-like recording medium in the series of the job has passed through the fixing device within a range in which the temperature of the means for heating increases to the temperature set for the fixing operation before the sheet-like recording medium for a following image forming operation is conveyed to the fixing device.

23. The image forming apparatus according to claim 21, further comprising:

means for detecting a temperature of the means for pressing, the means for pressing including a heating source, wherein the means for controlling is adapted to control the heating source of the means for pressing such that the temperature of the means for pressing is decreased from the temperature set for the fixing operation to the predetermined temperature after the means for determining determines that the last sheet-like recording medium in a series of the job has passed through the fixing device.

24. The image forming apparatus according to claim 21, wherein no heat absorbing member is provided to the heating position except for the rotatable endless belt.

25. The image forming apparatus according to claim 21, wherein the temperature of the rotatable endless belt gradually decreases within the predetermined range when the sheet-like recording media successively pass through the nip region while the temperature of the rotatable endless belt is controlled to be maintained at the predetermined temperature.

26. The image forming apparatus according to claim 24, wherein the means for heating including the heating source is provided within the loop of the rotatable endless belt to contact the rotatable endless belt to heat the rotatable endless belt, and wherein the means for controlling controls the temperature of the rotatable endless belt based on the detection result of the means for detecting that detects a surface temperature of the means for heating.

27. The image forming apparatus according to claim 23, further comprising:

means for inhibiting an excessive temperature increase of the rotatable endless belt provided to at least one of the means for pressing and the means for heating.

* * * * *